US011199055B2

(12) United States Patent
Odegbami

(10) Patent No.: US 11,199,055 B2
(45) Date of Patent: Dec. 14, 2021

(54) ELECTRICAL CONNECTOR FOR OIL AND GAS APPLICATIONS

(71) Applicant: Halliburton Energy Services, Inc., Houston, TX (US)

(72) Inventor: Olumide O. Odegbami, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 17 days.

(21) Appl. No.: 16/827,938

(22) Filed: Mar. 24, 2020

(65) Prior Publication Data

US 2020/0340305 A1 Oct. 29, 2020

(30) Foreign Application Priority Data

Apr. 29, 2019 (WO) ..... PCT/US2019/029689

(51) Int. Cl.
*E21B 17/02* (2006.01)
*E21B 47/12* (2012.01)

(52) U.S. Cl.
CPC ..... *E21B 17/028* (2013.01); *E21B 47/12* (2013.01)

(58) Field of Classification Search
CPC ..... E21B 17/028; E21B 47/12; E21B 47/26; H01R 24/38
See application file for complete search history.

(56) References Cited

U.S. PATENT DOCUMENTS 4,928,088 A 5/1990 Jorion et al.
4,960,391 A 10/1990 Beinhaur et al.
5,515,039 A * 5/1996 Delattore ..... E21B 47/12 340/853.9
6,071,144 A 6/2000 Tang
6,582,251 B1 6/2003 Burke et al.
6,831,571 B2 12/2004 Bartel
7,442,081 B2 10/2008 Burke et al.
7,581,976 B2 9/2009 Liepold et al.
7,720,538 B2 5/2010 Janzig et al.
9,634,427 B2 4/2017 Lerner et al.
9,765,575 B2 9/2017 Hradecky et al.
(Continued)

FOREIGN PATENT DOCUMENTS

EP 0102672 A1 3/1984
EP 0522687 A2 1/1993

OTHER PUBLICATIONS

"Glass Sealed Hermetic Connectors"; Digi-Key; digikey.com; Hermetic Connectors; www.ittcannon.com; 49 pgs.

*Primary Examiner* — Brad Harcourt
(74) *Attorney, Agent, or Firm* — Benjamin Ford; Parker Justiss, P.C.

(57) ABSTRACT

A drill string readout port connector assembly including a receptacle body and a connector body. The receptacle body is located in an aperture in a sidewall of a drill collar and a mounting surface of the receptacle body includes a mounting surface ring-shaped electrically conductive structure. The connector body has an insertion end shaped to fit inside the aperture and to face the mounting surface and a landing surface of the insertion end includes a corresponding a landing surface ring-shaped electrically conductive structure positioned to align with and physically contact the mounting surface ring-shaped electrically conductive structure.

22 Claims, 6 Drawing Sheets

(56) References Cited

U.S. PATENT DOCUMENTS

| | | | | |
|---|---|---|---|---|
| 2003/0218547 | A1* | 11/2003 | Smits | E21B 47/12 340/853.9 |
| 2004/0242044 | A1 | 12/2004 | Head | |
| 2005/0145416 | A1 | 7/2005 | Reed et al. | |
| 2010/0224416 | A1 | 9/2010 | Montgomery et al. | |
| 2013/0120154 | A1 | 5/2013 | Gleitman | |
| 2014/0104073 | A1 | 4/2014 | Fraignac et al. | |
| 2016/0043505 | A1* | 2/2016 | Wu | H01R 35/02 439/217 |
| 2017/0349055 | A1* | 12/2017 | Kilic | B60L 53/16 |
| 2018/0010031 | A1 | 1/2018 | Galindo et al. | |

* cited by examiner

ELECTRICAL CONNECTOR FOR OIL AND GAS APPLICATIONS

CROSS-REFERENCE TO RELATED APPLICATION

This application is a continuation of and claims priority to International Application Ser. No. PCT/US2019/029689 filed on Apr. 29, 2019, and entitled "ELECTRICAL CONNECTOR FOR OIL AND GAS APPLICATIONS," which is commonly assigned with this application and incorporated herein by reference in its entirety.

BACKGROUND

In the oil and gas industry, traditional drill string side wall read out (SWRO) connector assembly designs can be limiting and restrict manufacturing, assembly and operational effectiveness. For instance, previous connector assembly designs have insertion orientation issues where, e.g., a pattern of conductive pins need to be specifically oriented to fit into sockets of the receptacle body, thereby increasing the time needed to couple a probe tool to the receptacle body, and thus increasing the amount of time before being able to access any necessary data. Often, a two-conductor design uses a center pin and the body for ground, however for higher data rate systems with full duplex broadband capabilities, four-conductor (or more) designs are used. This can present a problem for pin oriented connections associated with a communications port of a drill collar.

BRIEF DESCRIPTION

Figure 1:
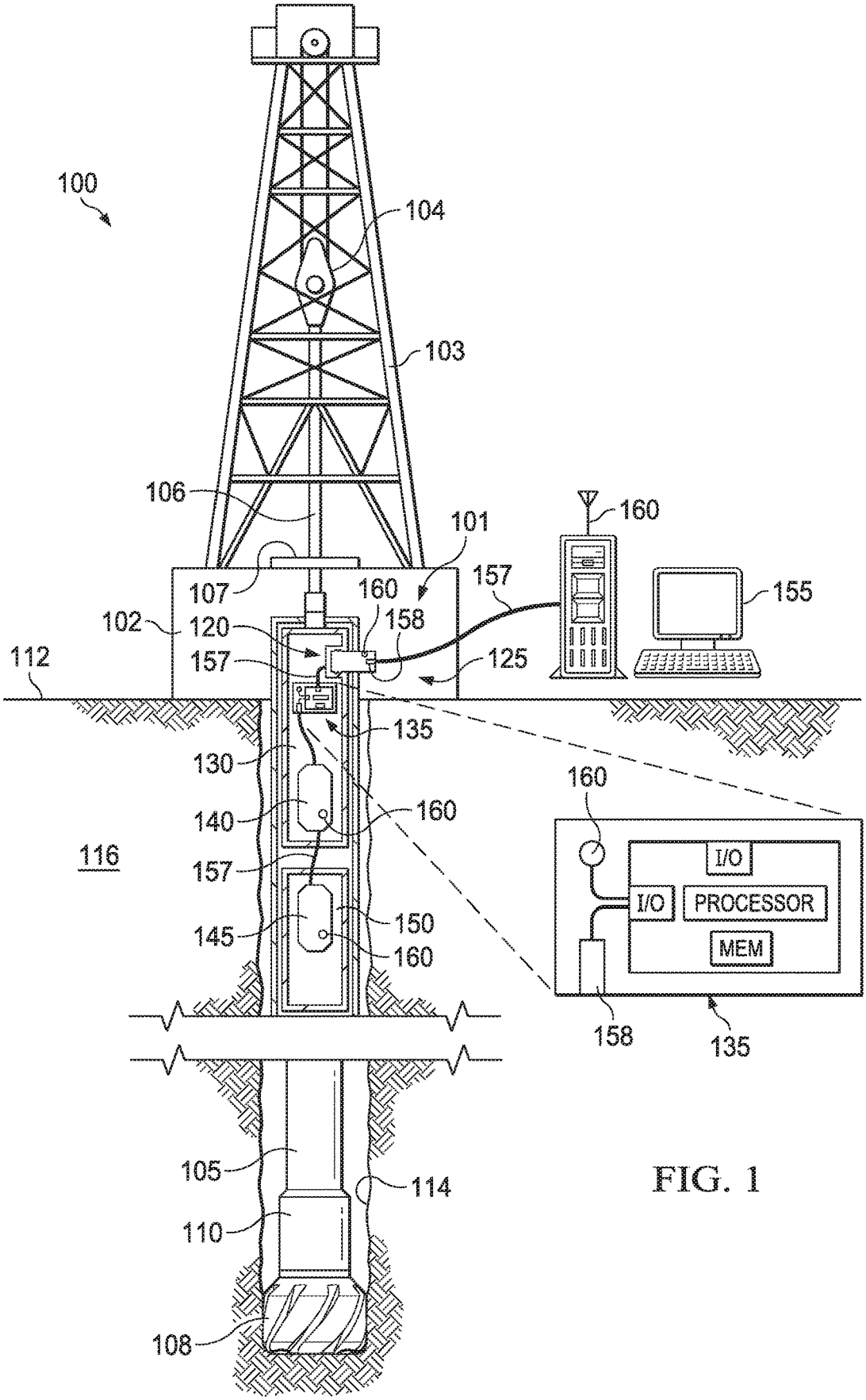
Figure 2:
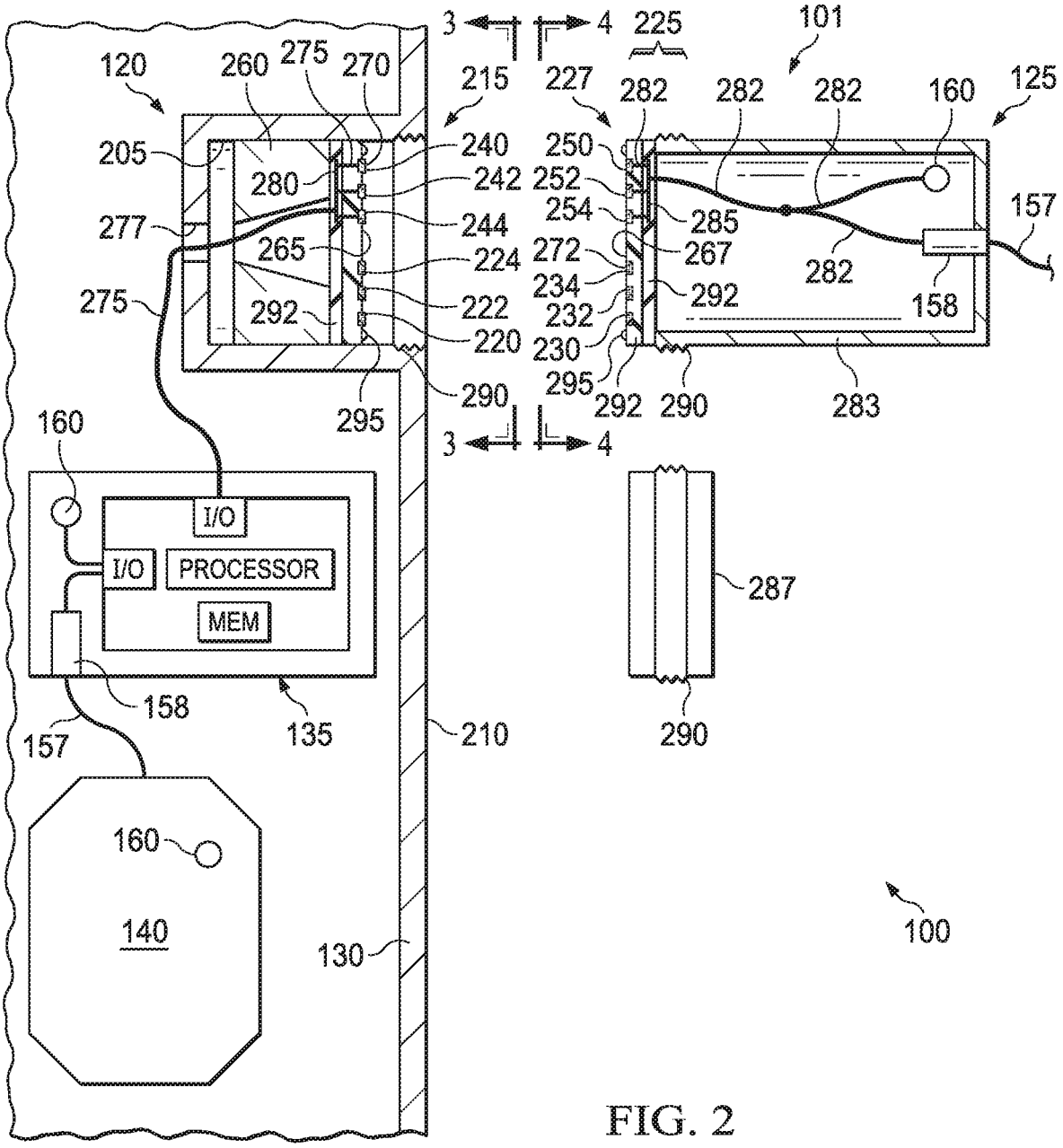
Figure 3:
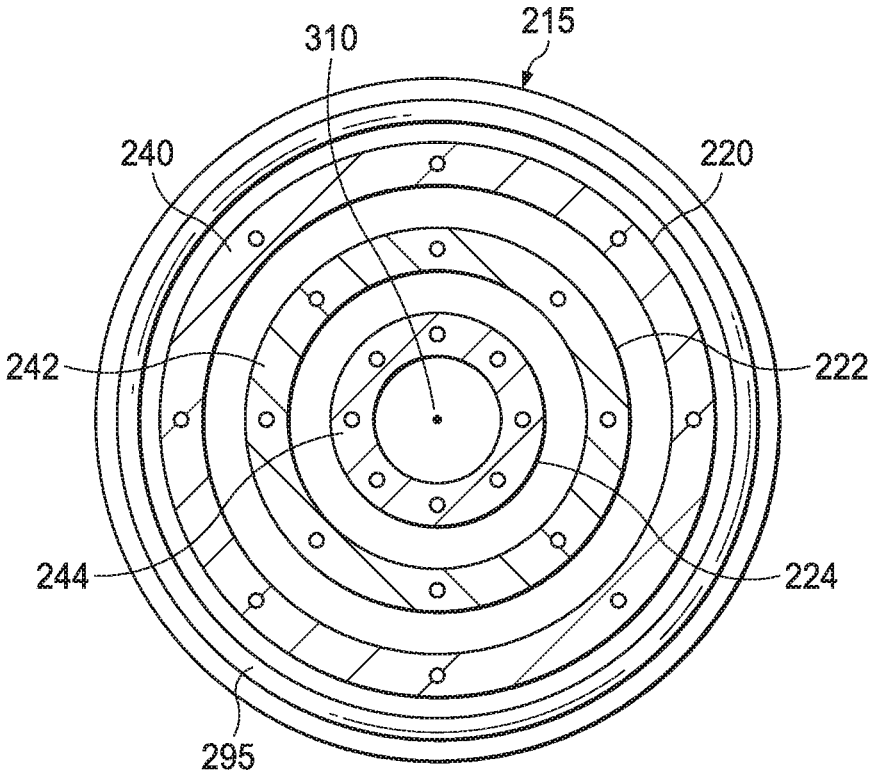
Figure 4A:
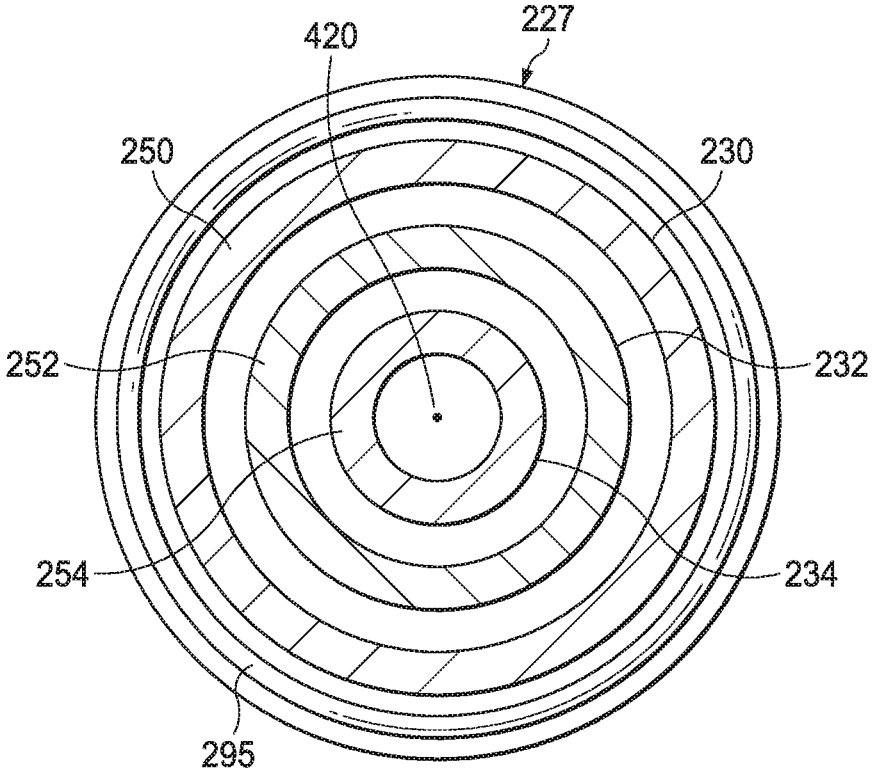
Figure 4B:
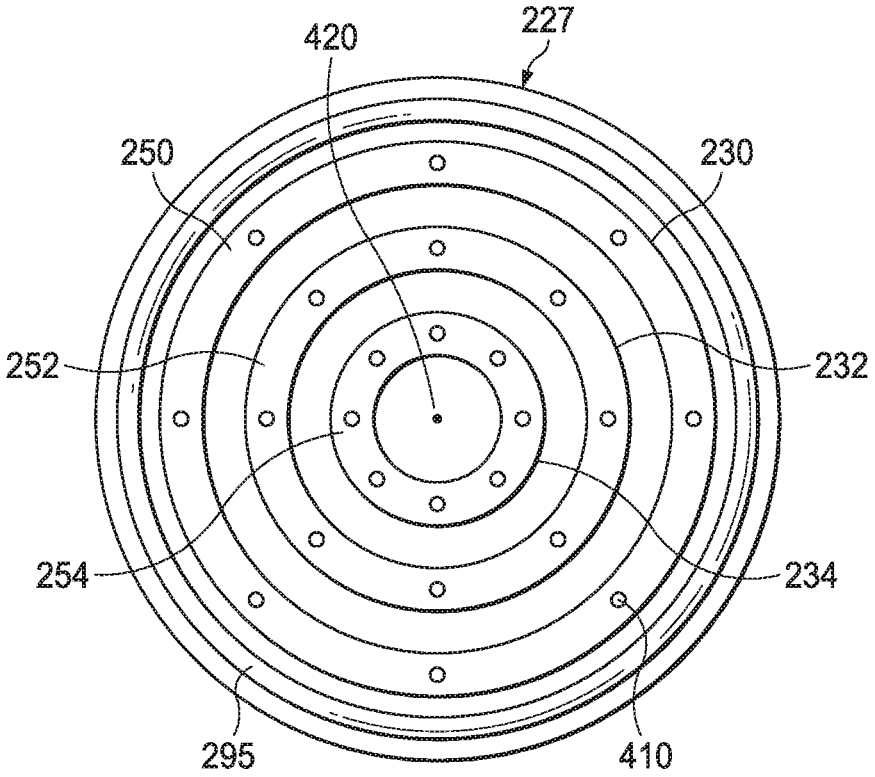
Figure 5:
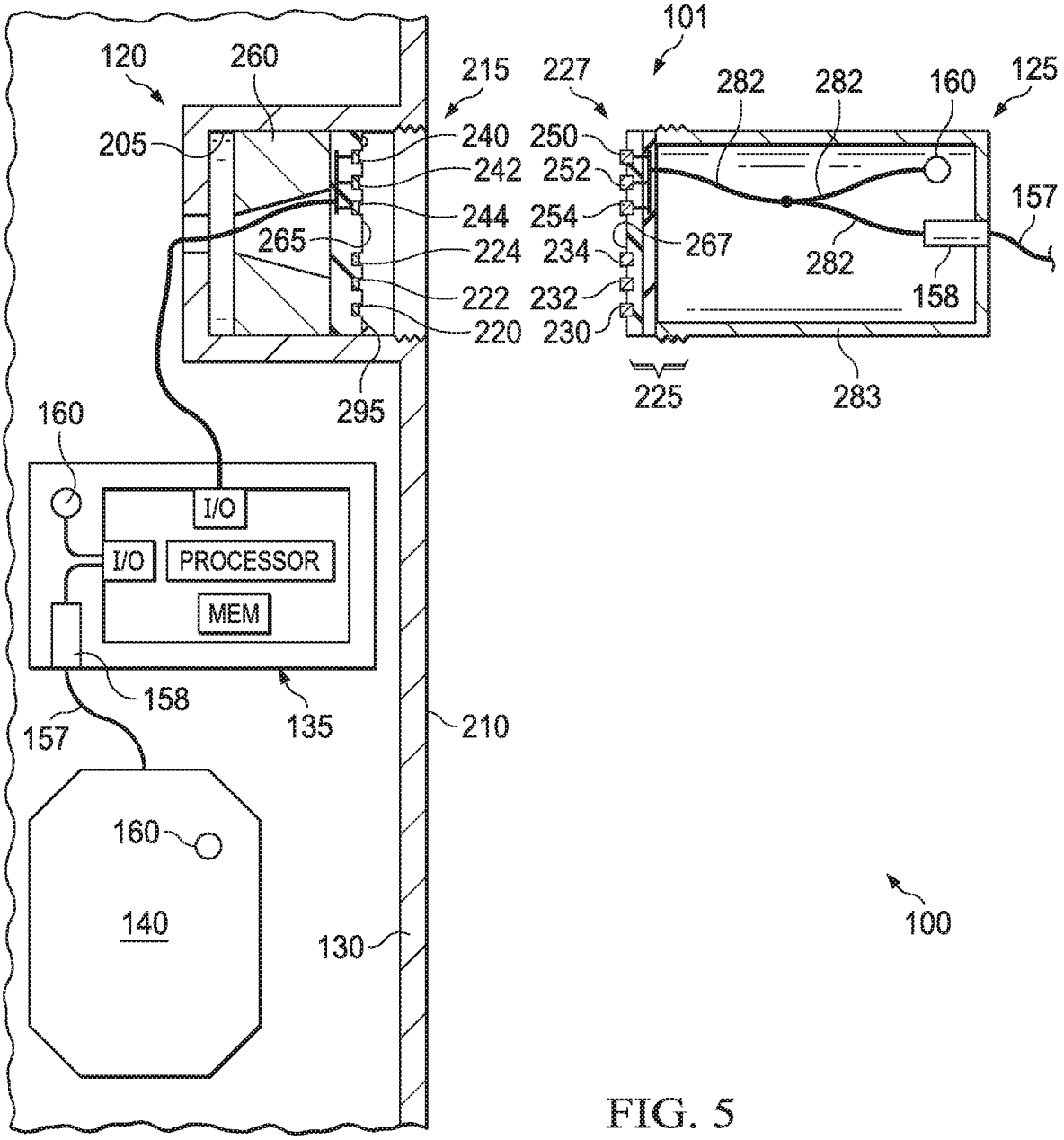
Figure 6:
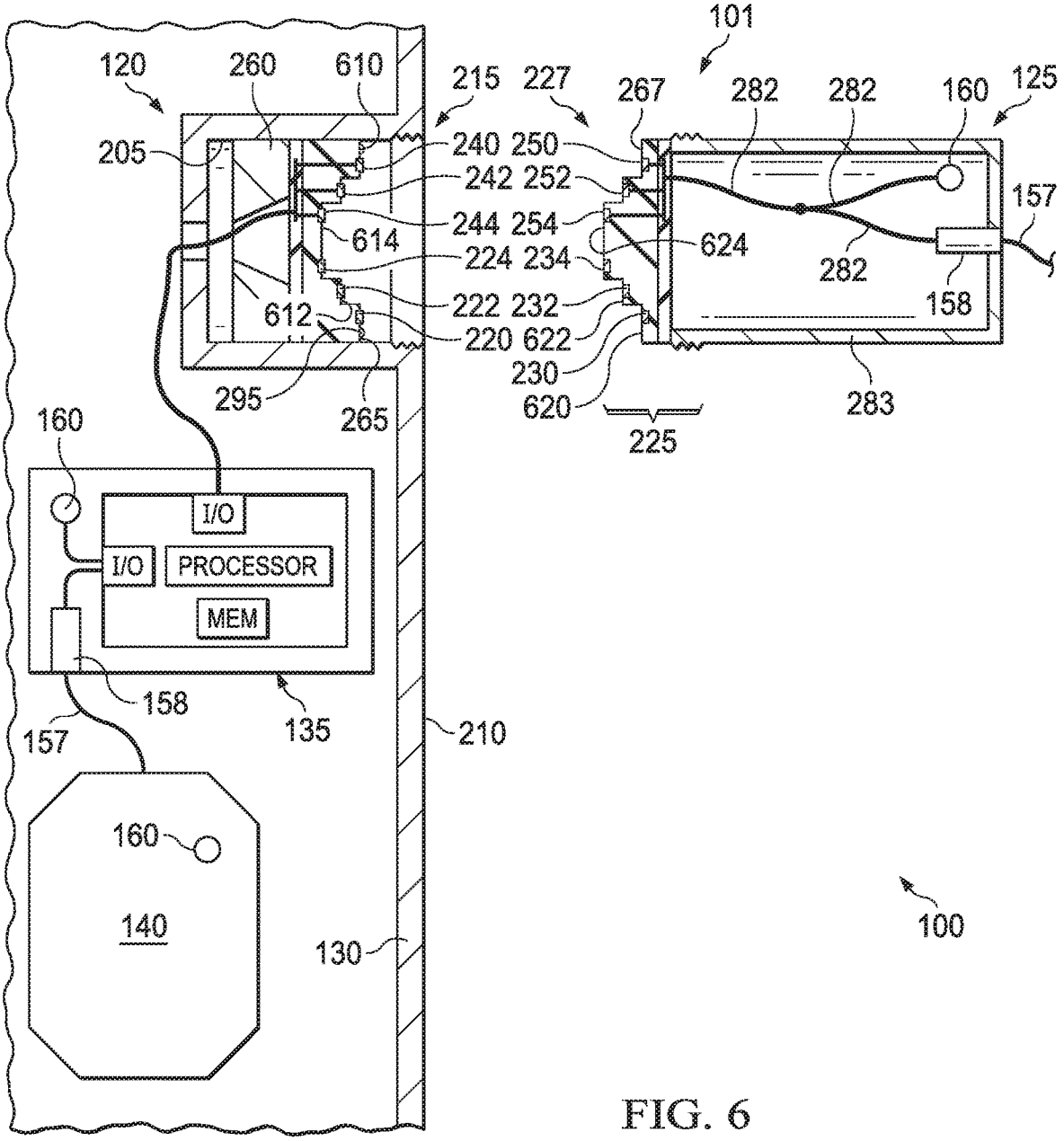

Reference is now made to the following descriptions taken in conjunction with the accompanying drawings, in which:

FIG. 1 presents a schematic view of an illustrative embodiment of an oil and gas well drilling system, using a drill string readout port connector assembly in accordance with embodiments of the disclosure;

FIG. 2 presents a cross-sectional side view of an embodiment of the drill string readout port connector assembly embodiment of the disclosure;

FIG. 3 presents a front view of a receptacle body embodiment of the drill string readout port connector assembly shown along view line 3-3 in FIG. 2;

FIG. 4A presents a front view of a connector body embodiment of the drill string readout port connector assembly shown along view line 4-4 in FIG. 2;

FIG. 4B present a front view of another connector body embodiment of the drill string readout port connector assembly shown along view line 4-4 in FIG. 2;

FIG. 5 presents a cross-sectional side view of another drill string readout port connector assembly embodiment according to the disclosure; and FIG. 6 presents a cross-sectional side view of another drill string readout port connector assembly embodiment according to the disclosure.

DETAILED DESCRIPTION

The present disclosure relates generally to logging-while-drilling (LWD) or measuring-while-drilling (MWD) tools, and more specifically the passing or routing of electrical data (e.g., data recorded from such tools), or power, through a drill string readout port connector assembly (e.g., a SWRO connector assembly) as disclosed herein.

Embodiments of the drill string readout port connector assembly disclosed herein include a ring-style connector design that is easy to use in the field, and thus easy to quickly couple to connector bodies. Such a connection may, in certain embodiments, be made without requiring precise alignment and orientation features, and thereby reduces the amount of time needed to access probe tool data.

FIG. 1 presents a schematic view of an illustrative embodiment of an oil and gas well drilling system 100, using the drill string readout port connector assembly 101 in accordance with embodiments of the disclosure.

As illustrated, the oil and gas well drilling system 100 may include a drilling platform 102 that supports a derrick 103 having a traveling block 104 for raising and lowering a drill string 105. The drill string 105 may include, but is not limited to, drill pipe and drill collars, as generally known to those skilled in the art. A kelly 106 may support the drill string 105 as it is lowered through a rotary table 107. A drill bit 108 may be attached to a distal end of the drill string 105 and may be driven either by a downhole motor 110 (e.g., a mud motor) and/or with rotation of the drill string 105 via the rotary table 107 from the well surface 112 (e.g., the earth's surface or the surface of an sea-born drilling system 100). The drill bit 108 may include, but is not limited to, roller cone bits, polycrystalline diamond compact bits, natural diamond bits, any hole openers, reamers, coring bits, etc. As the drill bit 108 rotates, it may create a wellbore 114 that penetrates various subterranean formations 116.

The drill string readout port connector assembly 101 includes a receptacle body 120 and connector body 125 (e.g., a data download connector body). As illustrated and further disclosed in detail below, the receptacle body 120 is located in an aperture in a sidewall of a drill collar 130 that is part of the drill string 105. The receptacle body 120 can be configured to pass and/or route electrical data communications or power to/from a central memory module 135 and/or one of more LWD or MWD probe tools 140, 145 in the drill collar 130. The central memory module 135 can be configured to pass or route the electrical data communications to/from one of more of the LWD or MWD probe tools 140, 145 located in the drill collar 130, or another drill collar 150 of the drill string 105. The connector body 125 can be configured to pass or route the electrical data communications to/from a surface computer 155 of the oil and gas well drilling system 100. In some embodiments, the central memory module 135 may not be the only source of electrical data communications and power routing between LWD or MWD probe tools 140, 145 and the surface computer 155. For instance, the surface computer 155 can be configured to directly make point-to-point communications of electrical data and/or power to one or more sensors or actuators in the probe tools 140, 145.

As familiar to those skilled in the pertinent art, the probe tools 140, 145 may gather and record data about the borehole and the formations surrounding the borehole, among other valuable information. Non-limiting examples include steerable rotary tools, survey tools, formation valuation sensor tools, drilling parameter valuation tools, or formation sampler tools. As familiar to those skilled in the art, the probe tools 140, 145 can include a bus controller that manages communications between the various downhole sensors of the tools and a long haul telemetry system, as well as the assembly 101.

At least some of the electrical data gathered and recorded downhole by the probe tools 140, 145 can be stored within the probe tools 140, 145 as electrical digital information. The digital information can be transferred to the central memory module 135 from the probe tools 140, 145 via wired (e.g., via data cable bundles 157 and cable connectors 158) or wireless (e.g., via radio frequency or other electromagnetic frequency) antennas 160 using digital data transfer communication protocols (e.g., electrical or optical, serial or parallel, data transfer protocols) as familiar to those skilled in the pertinent art.

The central memory module 135 (e.g., a processor or an application specific integrated circuit, application specific integrated circuit (ASIC), in some embodiments) can include non-volatile random access memory (MEM). Embodiments of the MEM can include random accessory memory (RAM) with a battery backup, static RAM (SRAM), electrically erasable programmable read-only memory (EEPROM), solid state magnetic-type RAM, optical storage media, PCMCIA compliant devices, smart media devices, compact flash devices or combinations thereof, or other NVRAM forms familiar to those skilled in the art. The central memory module 135 can further include input/output devices (I/O) and a digital processor (PROCESSOR) configured to receive/send and digitally encode information from the probe tools 140, 145 to the surface computer 155, as familiar to those skilled in the pertinent art.

Once the drill collar 130 holding the central memory module 135 is brought to the surface 112 and the receptacle body 120 and the connector body 125 are connected together, the digital information stored in the central memory module 135 can be transferred to the connector body 125, and then from the connector body 125 to a surface computer 155 via similar wired or wireless communication and digital data transfer protocols familiar to those skilled in the pertinent art. Similarly, data, configuration information, and/or instructions from a surface computer 155 can be sent to the central memory module 135 via the assembly 101. Such data exchange can occur simultaneously, full duplex, or in one direction at a time, half duplex.

Another embodiment of the disclosure is a drill string readout port connector assembly. FIG. 2 presents a cross-sectional side view of an embodiment of a drill string readout port connector assembly 101 of the disclosure, such as was previously described in the context of FIG. 1. FIG. 3 presents a front view of a receptacle body 120 of the drill string readout port connector assembly 101 shown along view line 3-3 in FIG. 2, and FIGS. 4A and 4B present front views of different connector body 125 embodiments of the drill string readout port connector assembly 101 shown along view line 4-4 in FIG. 2.

With continuing reference to FIGS. 1-4B throughout, the receptacle body 120 is located in an aperture 205 in a sidewall 210 of the drill collar 130. A mounting surface 215 of the receptacle body 120 includes one or more mounting surface ring-shaped electrically conductive structures (e.g., conductive structures 220, 222, 224). The connector body 125 has an insertion end 225 shaped to fit inside the aperture 205 and to face the mounting surface 215. A landing surface 227 of the insertion end 225 includes a corresponding one or more landing surface ring-shaped electrically conductive structures (e.g., conductive structures 230, 232, 234) positioned to align with and physically contact at least one of the mounting surface ring-shaped electrically conductive structures 220, 222, 224 of the receptacle body 120.

As illustrated in FIG. 3, embodiments of the mounting surface ring-shaped electrically conductive structures 220, 222, 224 can include one or more circularly-shaped rings. As illustrated in FIG. 4A, embodiments of the corresponding landing surface ring-shaped electrically conductive structures 230, 232, 234 can each have a circular shape, or as illustrated in FIG. 4B, a circular pattern of separate conductive members 410, that mirror the circular shape (or shapes) of at least one of the mounting surface ring-shaped electrically conductive structures 220, 222, 224.

Based on the present disclosure, one skilled in the pertinent art would understand how the mounting surface ring-shaped electrically conductive structures 220, 222, 224 could have other non-circular shapes such as partial circles (e.g., semi circles or arcs) elliptical, square or irregular shapes, and the corresponding landing surface ring-shaped electrically conductive structures 230, 232, 234 could have analogous shapes that mirror these non-circular shapes. For such non-circular shapes however, unlike having a circular pattern, one or both of the receptacle body 120 and the connector body 125 may have to include alignment features (e.g., mating tabs and/or holes, or an alignment mark on the receptacle and probe bodies, among others) to ensure that the landing surface ring-shaped electrically conductive structures 230, 232, 234 physically contact the mounting surface ring-shaped electrically conductive structures 220, 222, 224. The need for such guide features may provide certain drawbacks, because adding such alignment features increases the expense of the bodies 120, 125 manufacture, the features are prone to wearing out or breakage, it can take more time to connect the receptacle body 120 and the connector body 125 together, and the connection of bodies 120, 125 is more prone to misalignment.

Thus some embodiments of the drill string readout port connector assembly 101 have a receptacle body 120 and connector body 125 that are advantageously free of guide features, which would otherwise be necessary to guide alignment and set a fixed orientation of the landing surface 227 with respect to the mounting surface 215. For instance, consider embodiments where the mounting surface ring-shaped electrically conductive structures 220, 222, 224 consist of circularly-shaped rings and the corresponding landing surface ring-shaped electrically conductive structures 230, 232, 234 each have a continuous circular shape, or a circular pattern of separate conductive members 410. When the receptacle body 120 and connector body 125 are mated together, the circular mounting surface ring-shaped electrically conductive structures 220, 222, 224 will be automatically aligned with the circular landing surface ring-shaped electrically conductive structures 230, 232, 234, and thus provide a simple and reliable means of creating electrical pathways for data transfer.

As further illustrated in FIGS. 2-3, for some embodiments of the drill string readout port connector assembly 101, to facilitate having an automatically alignable and guide feature-free connection, the mounting surface ring-shaped electrically conductive structures can include two or more circularly-shaped rings that are concentric with each other and diametrically aligned with each other (e.g., rings 220, 222, 224). The term diametrically aligned means that each of the mounting surface ring-shaped electrically conductive structures have a same focus 310 (e.g., a same center focus point 310 for concentric circular or square rings) or foci (e.g., same multiple foci points or concentric elliptical rings).

Similarly, as illustrated in FIGS. 2 and 4A-4B, to facilitate having such an automatically alignable and guide feature-free connection, the corresponding landing surface ring-shaped electrically conductive structures can include two or more circularly-shaped rings, or the circular pattern of separate conductive members, that are concentric with each other and diametrically aligned with each other (e.g., conductive ring structures 230, 232, 234 having a same center focus point 420).

As further illustrated in FIGS. 2-4B, for some embodiments of the drill string readout port connector assembly 101, to provide a quick connect-disconnect between the receptacle body 120 and connector body 125, outer surfaces 240, 242, 244 of the mounting surface ring-shaped electrically conductive structures 220, 222, 224 can be coplanar with each other, and, the opposing outer surfaces 250, 252, 254 of the corresponding landing surface ring-shaped electrically conductive structures 230, 232, 234 can be coplanar with each other.

As also illustrated in FIGS. 2-4B, for some embodiments of the drill string readout port connector assembly 101, to facilitate having such an automatic alignment-feature free connection, the outer surfaces 240, 242, 244 of the mounting surface ring-shaped electrically conductive structures 220, 222, 224 can be coplanar with an outer planar surface 265 of a support member 260 of the receptacle body 120, the outer planar surface 265 located at the mounting surface 215. Similarly, as illustrated in FIGS. 2 and 4A-4B, the outer surfaces 250, 252, 254 of the corresponding landing surface ring-shaped electrically conductive structures 230, 232, 234 can be coplanar with an outer planar surface 267 of the connector body 125 at the landing surface 227.

FIG. 5 presents a cross-sectional side view of another drill string readout port connector assembly 101 embodiment according to the disclosure. As illustrated, the outer surfaces 240, 242, 244 of the mounting surface ring-shaped electrically conductive structures 220, 222, 224 are coplanar with each other and recessed from the outer planar surface 265 (e.g., recessed toward the center of the drill collar 130) of the support member 260 of the receptacle body 215 at the mounting surface 215. As further illustrated in FIG. 5, the outer surfaces 250, 252, 254 of the corresponding landing surface ring-shaped electrically conductive structures 230, 232, 234 can be coplanar with each other and project out from an outer planar surface 267 of the connector body's 125 landing surface 227 (e.g., away from and interior of the connector body 125 and towards the receptacle body 120 when being connected). The recessed mounting surface ring-shaped electrically conductive structures 220, 222, 224 and outward projecting corresponding landing surface ring-shaped electrically conductive structures 230, 232, 234 can advantageously provide a more rigid connection between the receptacle body 120 and the connector body 125. Additionally, the individual mounting surface ring-shaped electrically conductive structures 220, 222, 224 are better insulated from each other, e.g., as compared to the mounting surface ring-shaped electrically conductive structures illustrated in FIG. 2.

FIG. 6 presents a cross-sectional side view of still another drill string readout port connector assembly 101 embodiment according to the disclosure. As illustrated, the outer surfaces 240, 242, 244 of the mounting surface ring-shaped electrically conductive structures 220, 222, 224 are each located on separate recessed ledges 610, 612, 614 of the support member 260 of the receptacle body 120. The separate recessed ledges 610, 612, 614 are recessed by different distances towards an interior of the drill collar 130 such that the outer surfaces 240, 242, 244 of the mounting surface ring-shaped electrically conductive structures 220, 222, 224 are non-coplanar with each other. As further illustrated in FIG. 6, the outer surfaces 250, 252, 254 of the corresponding landing surface ring-shaped electrically conductive structures 230, 232, 234 at the landing surface 227 are located on separate dowel ledges 620, 622, 624 that project correspondingly different distances away from an outer planar surface 267 of the connector body's 125 landing surface 227 (e.g., away from an interior of the connector body 125 and towards the receptacle body 120 when being connected) such that the outer surfaces 250, 252, 254 of the corresponding landing surface ring-shaped electrically conductive structures 230, 232, 234 are non-coplanar with each other. The multi-tiered recessed mounting surface ring-shaped electrically conductive structures 220, 222, 224 and corresponding multi-tiered outward projecting corresponding landing surface ring-shaped electrically conductive structures 230, 232, 234 can advantageously provide a more rigid connection between the receptacle body 120 and the connector body 125. Additionally, the individual mounting surface ring-shaped electrically conductive structures 220, 222, 224 are better insulated from each other, e.g., as compared to the coplanar mounting surface ring-shaped electrically conductive structures 220, 222, 224 illustrated in FIG. 2.

Several optional features of the drill string readout port connector assembly 101 embodiments are further illustrated in FIG. 2. However, any of these features could be also incorporated into any of the drill string readout port connector assembly 101 embodiments, e.g., such as discussed in the context of any of the figures.

With continuing reference to FIGS. 1-6, as illustrated in FIG. 2, in some embodiments, to facilitate making a reliable electrical contacts, the mounting surface ring-shaped electrically conductive structures 220, 222, 224, or, the corresponding landing surface ring-shaped electrically conductive structures 230, 232, 234 can further include spring loaded electrically conductive pins 270, 272 (e.g., pogo pins®, Everett Charles Technologies, Fontana, Calif.). For instance, in some embodiments the separate conductive members 410 can be or can include spring-loaded pins.

As illustrated, in some embodiments, the mounting surface ring-shaped electrically conductive structures 220, 222, 224 (e.g., comprising copper, nickel or other metals familiar to those skilled in the pertinent art) can each be connected to electrically conductive wires 275 (e.g., comprising polypropylene, fluorinated ethylene propylene, perfluoroalkoxy, polytetrafluoroethylene and/or polyimide or other insulating tubing encapsulating wire conductors such as solid or stranded, bare copper, tinned copper, nickel plated copper, or silver plated copper or other metal wires familiar to those skilled in the pertinent art). The wires 275 can be routed inside of a wireway path 277 in the drill collar 130, the wireway path 277 routing the wires 275 between the receptacle body 120 and the central memory module 135 in the drill collar 130, which, as noted in the context of FIG. 1, can, in turn, be configured to pass and/or route electrical data communications or power with a central memory module 135 and/or one of more LWD or MWD probe tools 140, 145 in the drill collar 130, or, another drill collar. For instance, copper or other metal wires can be soldered to the surface of the mounting surface ring-shaped electrically conductive structures 220, 222, 224 that face away from the mounting surface 215. In some embodiments, all of mounting surface ring-shaped electrically conductive structures are connected via the wires 275 to a single common wire or bus 280, to provide redundant electrical connections to the probe tool 140. Or in some embodiments, the bus 280 can maintain the separate connectivity of the mounting surface ring-shaped electrically conductive structures 220, 222, 224 so as to provide multiple separate electrical connections as a wire bundle to the central memory module 135 or beyond to multiple different probe tools 140, 145. For instance, in some embodiments, each of the mounting surface ring-shaped electrically conductive structures 220, 222, 224 can carry different voltages with the drill collar 130 serving as ground.

Each of the corresponding landing surface ring-shaped electrically conductive structures 230, 232, 234 can similarly be connected to wires 282, routed inside of the connector body 125. In some embodiments, the connector body 125 outer surface 283 (e.g., a metal casing) may also serve as an electrical connection, e.g. a ground, to the receptacle body 120 to provide another electrical pathway to facilitate passing or routing electrical data communications or power. The wires 282 can be connected to a single common wire or bus 285, to provide redundant electrical connections to the probe tool 140, or the bus 285 can maintain the separate connectivity of the landing surface ring-shaped electrically conductive structures 230, 232, 234, e.g., to send different sets of digital information collected from different probe tools 140, 145 to the surface computer 155.

As illustrated, in some embodiments, the drill string readout port connector assembly 101 can further include a cap 287 configured to connect to and cover the aperture 205 and the receptacle body 120 when the connector body 125 is not inserted in the receptacle body 120. The cap 287 can help to prevent downhole material from entering the aperture 205 or the receptacle body 120 when the drill collar 130 is in the wellbore 114.

As illustrated, embodiments of the drill string readout port connector assembly 101 can further include coupling structures 290 to secure the contact between the insertion end 225 of the connector body 125 and the mounting surface 215 of the receptacle body 120. For instance, the coupling structures 290 can include threads on interior surfaces along the aperture 205 or the receptacle body 120, and, corresponding threads on outer surface the insertion end 225 of the connector body 125, e.g., such that the connector body 125 can be screwed into the aperture 205 or the receptacle body 120 to secure the contact. However other coupling structures, such as latches or bayonet style mounting features, e.g., with radial pins on the receptacle body 120, and matching slots on the connector body 125, or vice versa, or other structures familiar to those skilled in the art may be used. In some embodiments, the cap 287 can include coupling structures 290 that are the same as used for the connector body 125.

As illustrated, in some embodiments, the mounting surface 215 of the receptacle body 120 can further include a polymer body 292 to help prevent downhole fluids (e.g., drilling mud or formation fluids) from entering the receptacle body 120 and shorting out wires 275 or other electrical components in the wireway path 277. The polymer body 292 can be shaped to cover the mounting surface of the receptacle body 120 such that the outer surfaces 240, 242, 244 of the mounting surface ring-shaped electrically conductive structures 220, 222, 224 are not covered by the polymer body 292 and a seal (e.g., a hermetic seal) is formed between the mounting surface 215 and the landing surface 227 when the insertion end 225 of the connector body 125 is inserted into the receptacle body 120. The polymer body 292 can be made of a heat resistant thermoplastic, such as a polyether ketone (PEEK) polymer (e.g., Arlon® 1000, Green Tweed, Houston Tex.). As illustrated, in some embodiments, the polymer body 292 can be configured as a flat disk that covers a planar outer surface 265 of a support member 260 of the receptacle body 120. However, in other embodiments, the polymer body 292 can be configured as a recessed disk e.g., to cover the separate recessed ledges 610, 612, 614 of the outer surface 265 (FIG. 6). Alternatively or additionally, the landing surface 227 of the connector body can further include a polymer body 292 shaped to cover the landing surface 227 of the connector body 125 such that the outer surfaces 250, 252, 254 of the corresponding landing surface ring-shaped electrically conductive structures 230, 232, 234 are not covered by the polymer body 292 and a seal is formed between the mounting surface 215 and the landing surface 227.

As illustrated, in some embodiments, additionally or alternatively, to help prevent downhole fluids from entering the receptacle body 120, the mounting surface 215 of the receptacle body 120 can further include one or more O-rings 295 (e.g., elastomeric O-rings). The O-rings 295 can be configured to contact the landing surface 227 when the insertion end 225 of the connector body 125 is inserted into the receptacle body 120. Alternatively, in some embodiments, the landing surface 227 of the connector body 125 can further include one or more O-rings 295 configured to contact the mounting surface 215 when the insertion end 225 of the connector body 125 is inserted into the receptacle body 120.

Those skilled in the art to which this application relates will appreciate that other and further additions, deletions, substitutions and modifications may be made to the described embodiments.

What is claimed is:

1. A drill string readout port connector assembly, comprising:

a receptacle body located in an aperture in a sidewall of a drill collar, wherein a mounting surface of the receptacle body includes a mounting surface ring-shaped electrically conductive structure; and a connector body having an insertion end shaped to fit inside the aperture and to face the mounting surface, wherein a landing surface of the insertion end includes a corresponding landing surface ring-shaped electrically conductive structure positioned to align with and physically contact the mounting surface ring-shaped electrically conductive structure, wherein an outer surface of the mounting surface ring-shaped electrically conductive structure is coplanar with an outer planar surface of a support member of the receptacle body at the mounting surface, and an outer surface of the corresponding landing surface ring-shaped electrically conductive structure is coplanar with an outer planar surface of the landing surface.

2. The drill string readout port connector assembly of claim 1, wherein the mounting surface ring-shaped electrically conductive structure is a circularly-shaped conductive ring, and the corresponding landing surface ring-shaped electrically conductive structure is a circularly-shaped conductive ring or circular pattern of separate conductive members.

3. The drill string readout port connector assembly of claim 1, wherein the receptacle body and the connector body are free of guide features that guide alignment and set a fixed orientation of the landing surface with respect to the mounting surface.

4. The drill string readout port connector assembly of claim 1, wherein the mounting surface ring-shaped electrically conductive structure is connected to an electrically conductive wire, the electrically conductive wire routed inside of a wireway path in the drill collar, the wireway path routing the electrically conductive wire between the receptacle body and a central memory module in the drilling collar.

5. The drill string readout port connector assembly of claim 1, further including coupling structures to secure contact between the insertion end of the connector body and the mounting surface of the receptacle body.

6. The drill string readout port connector assembly of claim 1, wherein the connector body is coupled to the receptacle body to receive data from a steerable rotary tool, survey tool, a formation valuation sensor tool, a drilling parameter valuation tool, or a formation sampler tool.

7. A drill string readout port connector assembly, comprising:

a receptacle body located in an aperture in a sidewall of a drill collar, wherein a mounting surface of the receptacle body includes a mounting surface ring-shaped electrically conductive structure; and a connector body having an insertion end shaped to fit inside the aperture and to face the mounting surface, wherein a landing surface of the insertion end includes a corresponding landing surface ring-shaped electrically conductive structure positioned to align with and physically contact the mounting surface ring-shaped electrically conductive structure, wherein:

the mounting surface includes two mounting surface ring-shaped electrically conductive structures and the landing surface includes two corresponding landing surface ring-shaped electrically conductive structures, and outer surfaces of the two mounting surface ring-shaped electrically conductive structures are recessed from an outer planar surface of a support member of the receptacle body at the mounting surface, and the outer surfaces of the two corresponding landing surface ring-shaped electrically conductive structures project out from an outer planar surface of the landing surface.

8. The drill string readout port connector assembly of claim 7, wherein the two mounting surface ring-shaped electrically conductive structures are concentric and diametrically aligned with each other.

9. The drill string readout port connector assembly of claim 7, wherein the outer surfaces of the two mounting surface ring-shaped electrically conductive structures are recessed from an outer planar surface of a support member of the receptacle body at the mounting surface, and the outer surfaces of the two corresponding landing surface ring-shaped electrically conductive structures project out from an outer planar surface of the landing surface.

10. The drill string readout port connector assembly of claim 7, wherein outer surfaces of the two mounting surface ring-shaped electrically conductive structures are each located on separate recessed ledges of a support member of the receptacle body, the separate recessed ledges recessed different distances towards an interior of the drill collar such that the outer surfaces of the two mounting surface ring-shaped electrically conductive structures are non-coplanar with each other, and outer surfaces of the two corresponding landing surface ring-shaped electrically conductive structures are located on separate dowel ledges that project correspondingly different distances away from an outer planar surface of the landing surface such that the outer surfaces of the two corresponding landing surface ring-shaped electrically conductive structures are non-coplanar with each other.

11. A drill string readout port connector assembly, comprising:

a receptacle body located in an aperture in a sidewall of a drill collar, wherein a mounting surface of the receptacle body includes a mounting surface ring-shaped electrically conductive structure; and a connector body having an insertion end shaped to fit inside the aperture and to face the mounting surface, wherein a landing surface of the insertion end includes a corresponding landing surface ring-shaped electrically conductive structure positioned to align with and physically contact the mounting surface ring-shaped electrically conductive structure, wherein the mounting surface ring-shaped electrically conductive structure or the corresponding landing surface ring-shaped electrically conductive structure includes spring loaded electrically conductive pins.

12. A drill string readout port connector assembly, comprising:

a receptacle body located in an aperture in a sidewall of a drill collar, wherein a mounting surface of the receptacle body includes a mounting surface ring-shaped electrically conductive structure; and a connector body having an insertion end shaped to fit inside the aperture and to face the mounting surface, wherein a landing surface of the insertion end includes a corresponding landing surface ring-shaped electrically conductive structure positioned to align with and physically contact the mounting surface ring-shaped electrically conductive structure, wherein the mounting surface further includes a polymer body, the polymer body covering the mounting surface such that an outer surface of the mounting surface ring-shaped electrically conductive structure is not covered by the polymer body and a seal is formed between the mounting surface and the landing surface when the insertion end of the connector body is inserted into the receptacle body.

13. A drill string readout port connector assembly, comprising:

a receptacle body located in an aperture in a sidewall of a drill collar, wherein a mounting surface of the receptacle body includes a mounting surface ring-shaped electrically conductive structure; and a connector body having an insertion end shaped to fit inside the aperture and to face the mounting surface, wherein a landing surface of the insertion end includes a corresponding landing surface ring-shaped electrically conductive structure positioned to align with and physically contact the mounting surface ring-shaped electrically conductive structure, wherein the mounting surface of the receptacle body further includes one or more O-rings, the one or more O-rings contactable with the landing surface when the insertion end of the connector body is inserted into the receptacle body.

14. An oil and gas well drilling system, comprising:

a drill string, the drill string including a drill collar; and a drill string readout port connector assembly, including:

a receptacle body located in an aperture in a sidewall of a drill collar, wherein a mounting surface of the receptacle body includes a mounting surface ring-shaped electrically conductive structure; and a connector body having an insertion end shaped to fit inside the aperture and to face the mounting surface, wherein a landing surface of the insertion end includes a corresponding landing surface ring-shaped electrically conductive structure positioned to align with and physically contact the mounting surface ring-shaped electrically conductive structure wherein an outer surface of the mounting surface ring-shaped electrically conductive structure is coplanar with an outer planar surface of a support member of the receptacle body at the mounting surface, and an outer surface of the corresponding landing surface ring-shaped electrically conductive structure is coplanar with an outer planar surface of the landing surface.

15. The oil and gas well drilling system of claim 14, further including a memory module in the drill collar, wherein the mounting surface ring-shaped electrically conductive structure is electrically connected to receive digital information stored in the memory module.

16. The oil and gas well drilling system of claim 15, further including a logging-while-drilling or a measuring-while-drilling tool in the drill collar or in another drill collar in the drill string.

17. The oil and gas well drilling system of claim 16, wherein the logging-while-drilling or measuring-while-drilling tool includes one or more of: a steerable rotary tool, survey tool, a formation valuation sensor tool, a drilling parameter valuation tool, or a formation sampler tool.

18. The oil and gas well drilling system of claim 14, further including a surface computer, wherein the connector body is coupled to pass or route electrical data communications or power between the surface computer and one or more of a central memory module or a probe tool in the drill collar.

19. An oil and gas well drilling system, comprising:

a drill string, the drill string including a drill collar; and a drill string readout port connector assembly, including:

a receptacle body located in an aperture in a sidewall of a drill collar, wherein a mounting surface of the receptacle body includes a mounting surface ring-shaped electrically conductive structure; and a connector body having an insertion end shaped to fit inside the aperture and to face the mounting surface, wherein a landing surface of the insertion end includes a corresponding landing surface ring-shaped electrically conductive structure positioned to align with and physically contact the mounting surface ring-shaped electrically conductive structure, wherein:

the mounting surface includes two mounting surface ring-shaped electrically conductive structures and the landing surface includes two corresponding landing surface ring-shaped electrically conductive structures, and outer surfaces of the two mounting surface ring-shaped electrically conductive structures are recessed from an outer planar surface of a support member of the receptacle body at the mounting surface, and the outer surfaces of the two corresponding landing surface ring-shaped electrically conductive structures project out from an outer planar surface of the landing surface.

20. An oil and gas well drilling system, comprising:

a drill string, the drill string including a drill collar; and a drill string readout port connector assembly, including:

a receptacle body located in an aperture in a sidewall of a drill collar, wherein a mounting surface of the receptacle body includes a mounting surface ring-shaped electrically conductive structure; and a connector body having an insertion end shaped to fit inside the aperture and to face the mounting surface, wherein a landing surface of the insertion end includes a corresponding landing surface ring-shaped electrically conductive structure positioned to align with and physically contact the mounting surface ring-shaped electrically conductive structure wherein, the mounting surface ring-shaped electrically conductive structure or the corresponding landing surface ring-shaped electrically conductive structure includes spring loaded electrically conductive pins.

21. An oil and gas well drilling system, comprising:

a drill string, the drill string including a drill collar; and a drill string readout port connector assembly, including:

a receptacle body located in an aperture in a sidewall of a drill collar, wherein a mounting surface of the receptacle body includes a mounting surface ring-shaped electrically conductive structure; and a connector body having an insertion end shaped to fit inside the aperture and to face the mounting surface, wherein a landing surface of the insertion end includes a corresponding landing surface ring-shaped electrically conductive structure positioned to align with and physically contact the mounting surface ring-shaped electrically conductive structure wherein, the mounting surface further includes a polymer body, the polymer body covering the mounting surface such that an outer surface of the mounting surface ring-shaped electrically conductive structure is not covered by the polymer body and a seal is formed between the mounting surface and the landing surface when the insertion end of the connector body is inserted into the receptacle body.

22. An oil and gas well drilling system, comprising:

a drill string, the drill string including a drill collar; and a drill string readout port connector assembly, including:

a receptacle body located in an aperture in a sidewall of a drill collar, wherein a mounting surface of the receptacle body includes a mounting surface ring-shaped electrically conductive structure; and a connector body having an insertion end shaped to fit inside the aperture and to face the mounting surface, wherein a landing surface of the insertion end includes a corresponding landing surface ring-shaped electrically conductive structure positioned to align with and physically contact the mounting surface ring-shaped electrically conductive structure wherein, the mounting surface of the receptacle body further includes one or more O-rings, the one or more O-rings contactable with the landing surface when the insertion end of the connector body is inserted into the receptacle body.

* * * * *